US010530104B2

(12) United States Patent
Zhang et al.

(10) Patent No.: US 10,530,104 B2
(45) Date of Patent: Jan. 7, 2020

(54) CABLE-CONNECTOR ASSEMBLY WITH HEAT-SHRINK SLEEVE

(71) Applicant: CommScope Technologies LLC, Hickory, NC (US)

(72) Inventors: Yujun Zhang, Jiangsu (CN); Li Zhang, Jiangsu (CN); Hongwei Shen, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 15/781,436

(22) PCT Filed: Jan. 16, 2017

(86) PCT No.: PCT/CN2017/071210

§ 371 (c)(1),
(2) Date: Jun. 4, 2018

(87) PCT Pub. No.: WO2017/121402

PCT Pub. Date: Jul. 20, 2017

(65) Prior Publication Data

US 2018/0375266 A1 Dec. 27, 2018

(30) Foreign Application Priority Data

Jan. 15, 2016 (CN) ..... 2016 1 0024900

(51) Int. Cl.
*H01R 24/38* (2011.01)
*H01R 4/72* (2006.01)
(Continued)

(52) U.S. Cl.
CPC ..... *H01R 24/38* (2013.01); *H01R 4/72* (2013.01); *H01R 13/502* (2013.01); *H01R 43/20* (2013.01);
(Continued)

(58) Field of Classification Search
CPC ..... H01R 24/38; H01R 24/72
(Continued)

(56) References Cited

U.S. PATENT DOCUMENTS 3,502,788 A * 3/1970 Albert ..... H01R 9/0503 174/88 R
5,518,420 A * 5/1996 Pitschi ..... H01R 24/564 439/578
(Continued)

FOREIGN PATENT DOCUMENTS

CN 1173601 A 2/1998
CN 102391561 * 3/2012
(Continued)

OTHER PUBLICATIONS

International Search Report corresponding to International Application No. PCT/CN2017/071210 dated Apr. 21, 2017.
(Continued)

*Primary Examiner* — Tulsidas C Patel
*Assistant Examiner* — Peter G Leigh
(74) *Attorney, Agent, or Firm* — Myers Bigel, P.A.

(57) ABSTRACT

The present disclosures relates to cable-connector assembly with heat-shrink sleeve. The coaxial cable-connector assembly comprises: (a) a coaxial cable having an inner conductor, a dielectric layer circumferentially surrounding the inner conductor, an outer conductor circumferentially surrounding the dielectric layer, and a polymeric jacket circumferentially surrounding the outer conductor; (b) a coaxial connector having a central contact attached to the inner conductor of the coaxial cable, an outer conductor body attached to the outer conductor of the coaxial cable, and a dielectric spacer interposed between the central contact and the outer con-
(Continued)

ductor body; and (c) a heat shrink sleeve that conformably overlies a portion of the cable jacket and a portion of the outer body of the connector.

15 Claims, 2 Drawing Sheets

(51) Int. Cl.
*H01R 13/502* (2006.01)
*H01R 43/20* (2006.01)
*H01R 4/02* (2006.01)
*H01R 9/05* (2006.01)
*H01R 103/00* (2006.01)

(52) U.S. Cl.
CPC ..... *H01R 4/023* (2013.01); *H01R 9/05* (2013.01); *H01R 2103/00* (2013.01)

(58) Field of Classification Search
USPC ..... 439/578
See application file for complete search history.

(56) References Cited

U.S. PATENT DOCUMENTS 6,926,555 B2 * 8/2005 Nelson ..... H01R 24/44 439/578
7,637,774 B1 * 12/2009 Vaccaro ..... H01R 9/0521 29/828
7,934,954 B1 * 5/2011 Chawgo ..... H01R 9/0524 439/578
8,262,408 B1 * 9/2012 Kelly ..... H01R 9/0524 439/578
8,742,869 B2 * 6/2014 Hershtig ..... H01R 4/02 29/25.41
8,758,053 B2 * 6/2014 Paynter ..... H01R 4/5025 439/454
2005/0079759 A1 4/2005 Nelson
2005/0159043 A1 * 7/2005 Harwath ..... H01R 24/564 439/578
2009/0233482 A1 * 9/2009 Chawgo ..... H01R 9/0524 439/578
2012/0088407 A1 * 4/2012 Natoli ..... H01R 24/564 439/585
2012/0184135 A1 7/2012 Paynter et al.
2013/0323965 A1 * 12/2013 Buenz ..... H01R 24/38 439/578
2014/0102461 A1 * 4/2014 Girotra ..... A61F 11/12 128/864
2014/0102753 A1 * 4/2014 Wild ..... H01R 4/029 174/113 A
2014/0113486 A1 * 4/2014 Wild ..... H01R 4/029 439/578
2015/0101189 A1 * 4/2015 Paynter ..... H01R 4/5025 439/454

FOREIGN PATENT DOCUMENTS

CN 202308592 * 7/2012
CN 202308592 U 7/2012
CN 204929296 * 12/2015

OTHER PUBLICATIONS

Written Opinion of the International Searching Authority corresponding to International Application No. PCT/CN2017/071210 dated Apr. 21, 2017.
Office Action corresponding to Chinese Application No. 201610024900.9 dated Jul. 3, 2019.

* cited by examiner

CABLE-CONNECTOR ASSEMBLY WITH HEAT-SHRINK SLEEVE

FIELD OF THE INVENTION

The present invention is directed generally to electrical cable connectors, and more particularly to coaxial connectors for electrical cable.

BACKGROUND OF THE INVENTION

Coaxial cables are commonly utilized in RF communications systems. A typical coaxial cable includes an inner conductor, an outer conductor, a dielectric layer that separates the inner and outer conductors, and a jacket that covers the outer conductor. Coaxial cable connectors may be applied to terminate coaxial cables, for example, in communication systems requiring a high level of precision and reliability.

Coaxial connector interfaces provide a connect/disconnect functionality between a cable terminated with a connector bearing the desired connector interface and a corresponding connector with a mating connector interface mounted on an apparatus or on another cable. Typically, one connector will include a structure such as a pin or post connected to an inner conductor and an outer conductor connector body connected to the outer conductor; these are mated with a mating sleeve (for the pin or post of the inner conductor) and another outer conductor connector body of a second connector. Coaxial connector interfaces often utilize a threaded coupling nut or other retainer that draws the connector interface pair into secure electro-mechanical engagement when the coupling nut (which is captured by one of the connectors) is threaded onto the other connector. The interface between the cable and the connector is typically protected with a polymeric sleeve, tube or the like, often in the form of an "overmolded" body that is injection molded over the end of the cable and a narrowed portion of the connector. An exemplary overmold body is shown in U.S. Patent Publication No. 2014/0370747 to Vaccaro, the disclosure of which is hereby incorporated herein in its entirety.

Passive Intermodulation Distortion (PIM) is a form of electrical interference/signal transmission degradation that may occur with less than symmetrical interconnections and/or as electro-mechanical interconnections shift or degrade over time. Interconnections may shift due to mechanical stress, vibration, thermal cycling, and/or material degradation. PIM can be an important interconnection quality characteristic, as PIM generated by a single low quality interconnection may degrade the electrical performance of an entire RF system. Thus, the reduction/elimination of PIM via cable-connector design is typically desirable.

DETAILED DESCRIPTION

The present invention is described with reference to the accompanying drawings, in which certain embodiments of the invention are shown. This invention may, however, be embodied in many different forms and should not be construed as limited to the embodiments that are pictured and described herein; rather, these embodiments are provided so that this disclosure will be thorough and complete, and will fully convey the scope of the invention to those skilled in the art. It will also be appreciated that the embodiments disclosed herein can be combined in any way and/or combination to provide many additional embodiments.

Unless otherwise defined, all technical and scientific terms that are used in this disclosure have the same meaning as commonly understood by one of ordinary skill in the art to which this invention belongs. The terminology used in the above description is for the purpose of describing particular embodiments only and is not intended to be limiting of the invention. As used in this disclosure, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

Figure 1:
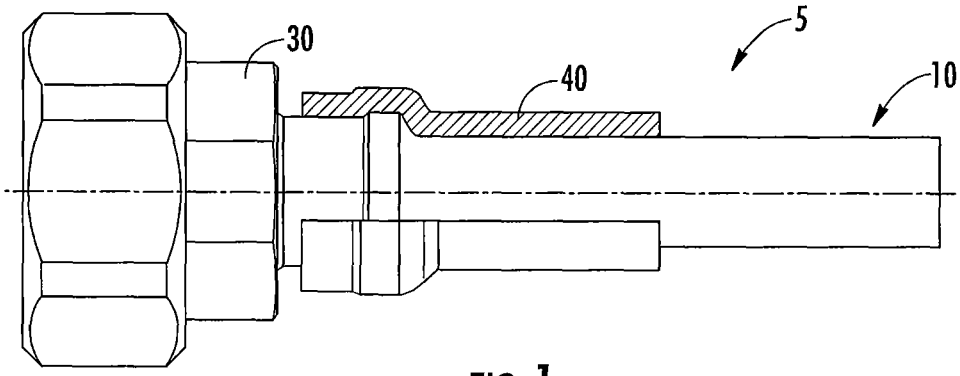
FIG. 1 is a partial cutaway side view of a cable-connector assembly according to embodiments of the present invention.
Figure 2:
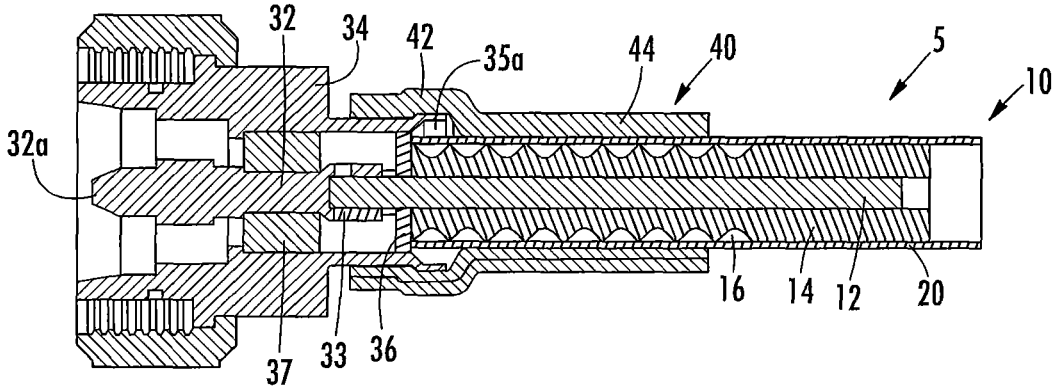
FIG. 2 is a side section view of the assembly of FIG. 1.

Referring now to the figures, a cable-connector assembly, designated broadly at 5, is shown in FIGS. 1 and 2. The assembly 5 includes a cable 10 and a connector 30. The cable 10 includes an inner conductor 12, a dielectric layer 14 that circumferentially overlies the inner conductor 12, an outer conductor 16 that circumferentially overlies the dielectric layer 14, and a polymeric cable jacket 20 that circumferentially overlies the outer conductor 16. In the illustrated embodiment, the outer conductor 16 is corrugated, but those of skill in this art will appreciate that the outer conductor 16 may be smooth, braided, or any other configuration known to be suitable for a coaxial cable. The cable 10 may be of any size, including ¼" and ⅜", and may be a jumper cable (such as an RF jumper cable) or another variety of cable.

The connector 30 includes a central contact 32 and an outer conductor body 34. The central contact 32 has a generally cylindrical post **32*a* and is mounted on and is in electrical contact with the inner conductor 12 of the cable 10 via a boss 33. The outer conductor body 34 is mounted in electrical contact with the outer conductor 16 of the cable 10 via a tail 35 that is soldered to the outer conductor 16 at a solder joint 35*a*. An annular dielectric spacer 36 is positioned between the central contact 32 and the outer conductor body 34 near the junction between the inner conductor 12 and the central contact 32. Another annular dielectric spacer 37 is positioned adjacent the closed end of the boss 33 and maintains separation between the central contact 32 and the outer conductor body 34. The spacers 36, 37 position the outer conductor body 34 to be spaced apart from and to circumferentially surround the central contact 32**.

Those of skill in this art will appreciate that the connector 30 may be a plug, a jack, or another variety of connector that may be interconnected with a mating connector. The connector 30 may be of any type, including 4.3/10, 7/16 DIN, and N-type connectors.

Figure 3:
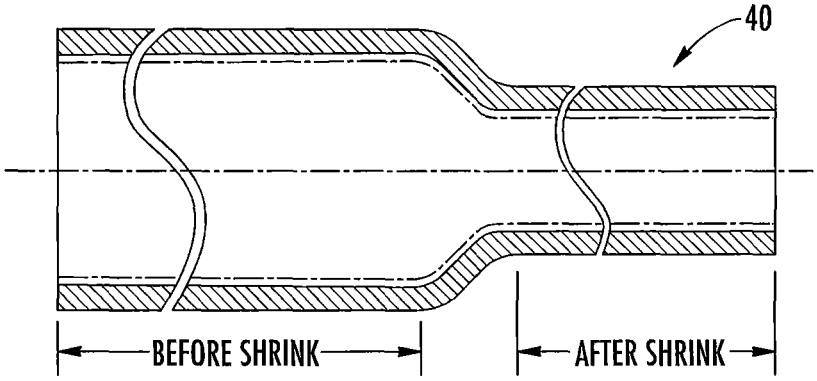
FIG. 3 is a schematic side section view of a heat shrink sleeve of the assembly of FIG. 1, shown in a pre-shrunken state (left side of the figure) and a shrunken state (right side of the figure).

As can be seen in FIGS. 1 and 2, the assembly 5 includes a heat shrink sleeve 40 that overlies the end of the cable 10 and the tail 35 of the outer conductor body 34 of the connector 30. The heat shrink sleeve 40 is formed of a material, such as a cross-linked polyolefin, that shrinks when heated (this is shown schematically in FIG. 3, wherein the wider left end of the sleeve 40 is shown prior to heating/shrinking, and the narrower right end is shown after heating/shrinking). One exemplary sleeve is the SBRS-(3X) tube (available from Woer, Pingshan, Shenzhen P.R.CHINA), which is a dual-layer tube having an outer layer of a cross-linked polyolefin and an inner layer of a hot melt adhesive. In some embodiments, it may be desirable for the inner diameter of the heat shrink sleeve 40 to shrink to about ⅓ of its original diameter (see Table 1 below).

TABLE 1

Heavy-Duty Heat-Shrink Sleeve Dimensions

| | Before Shrink | After Shrink | |
|---|---|---|---|
| Nominal Size (inch) | Min. Inner Diameter (mm) | Max. Inner Diameter (mm) | Thickness (mm) |
| ⅜ | 9.5 | 3.20 | 1.45 |
| ½ | 12.7 | 4.20 | 1.65 |
| ⅝ | 15.0 | 5.20 | 1.80 |
| ¾ | 19.1 | 6.30 | 1.95 |
| 1 | 25.4 | 8.50 | 2.00 |

The heat shrink sleeve 40 may have a thickness of between about 1.25 and 2.25 mm, and in some embodiments between about 1.4 and 2.0 mm. The heat shrink sleeve 40 may have a length of between about 40 and 60 mm. It will also be understood that, in some embodiments, more than one layer of heat shrink sleeve may be applied; for example, positive results have been achieved with two overlying layers of heat-shrink sleeves 40.

As noted above and as can be seen in FIG. 2, the heat shrink sleeve 40 conformably overlies the end of the cable 10 and the tail 35 (or other portion) of the outer conductor body 34. A wider portion 42 of the sleeve 40 shrinks to overlie the tail 35, and a narrower portion 44 shrinks to overlie a portion of the jacket 20 of the cable 10. Those skilled in this art will recognize that the underlying structures may have different sizes, dimensions and/or shapes (e.g., the tail 35 may be circular, hexagonal, square, or the like) and still be suitable for use with this invention.

The heat-shrink sleeve 40 is typically applied by inserting a terminated cable (i.e., the cable 10 with the connector 30 attached thereto) into the hollow core of the sleeve 40, then heating the sleeve 40 to cause it to shrink to conformably overlie the end of the cable 10 and a portion of the connector 30. Heating may be performed at a temperature of between about 125 and 200 degrees C.

It has been seen that cable-connector assemblies 5 that employ a heat shrink sleeve to protect the cable-connector interface (rather than using an overmolded body as was often done previously) can provide the assembly with unexpectedly strong performance in PIM testing conducted as the cable-connector interface is under stress.

As an example, a cable-connector assembly such as that described above (employing two heat-shrink sleeves 40 layered over each other) was subjected to PIM testing under three different stress-inducing conditions as defined by IEC-62037: impact (a 60 g weight dropped 30 cm onto the cable); 90 degree bending; and 360 degree twisting. PIM was measured for a 1,800 MHz band, in a sweep mode, with a power output of 2×43 dBm.

Figure 4:
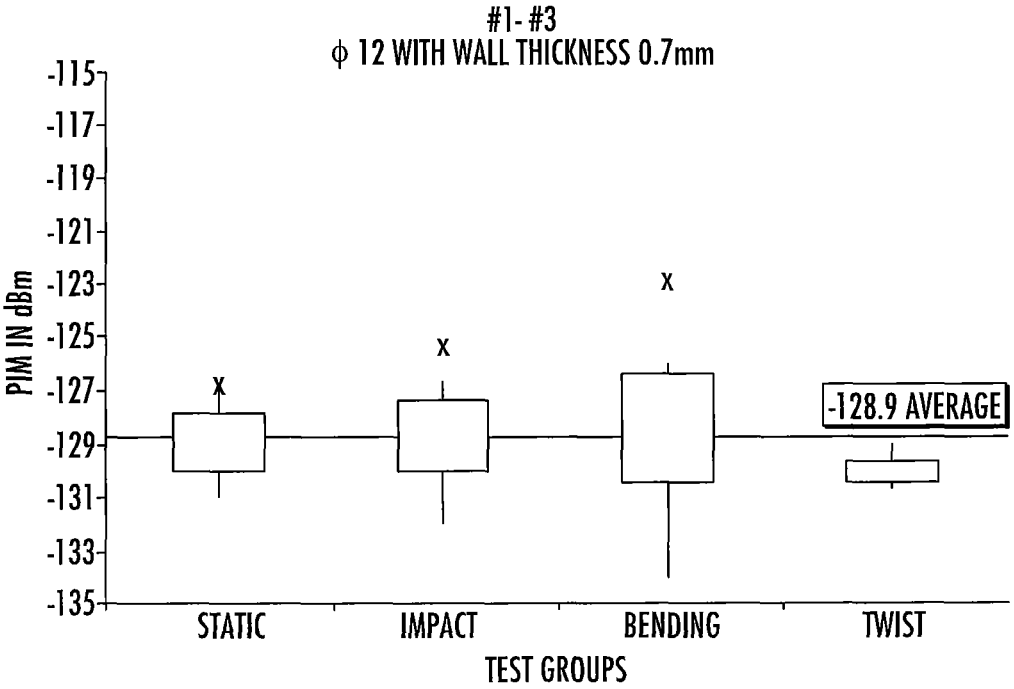
FIG. 4 is a graph showing the results of PIM testing for a cable-connector assembly of FIG. 1 under impact, bending and twisting conditions.

Results of the testing are shown in FIG. 4. In each instance (i.e., stress due to impact, bending, and twisting), the cable desirably exhibited an average PIM of approximately −129 dBm. This result indicates excellent PIM performance, as it falls below the desired PIM of an interface for 4.3/10 connectors (−119 dBm), 7/16 DIN connectors (−116 dBm) and N-type connectors (−112 dBm). Use of the heat-shrink sleeve 40 can provide good return loss over a wide frequency band (e.g., 45 MHz to 3,800 MHz).

Notably, inclusion of the heat shrink sleeve 40 can also provide environmental sealing of the interface as well as robust strain relief and mechanical protection for the connector (particularly soldered and/or clamped joints). Insulation and abrasion resistance may also be increased by use of the heat shrink sleeve 40.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A coaxial cable-connector assembly, comprising:

(a) a coaxial cable having an inner conductor, a dielectric layer circumferentially surrounding the inner conductor, an outer conductor circumferentially surrounding the dielectric layer, and a polymeric jacket circumferentially surrounding the outer conductor;

(b) a coaxial connector having a central contact attached to the inner conductor of the coaxial cable, an outer conductor body attached to the outer conductor of the coaxial cable, and at least two dielectric spacers interposed between the central contact and the outer conductor body, wherein one dielectric spacer is positioned separate and apart from the other dielectric spacer; and (c) a heat shrink sleeve that conformably overlies a portion of the cable jacket and a portion of the outer conductor body of the connector.

2. The assembly defined in claim 1, wherein the heat shrink sleeve comprises a polyolefin.

3. The assembly defined in claim 2, wherein the heat shrink sleeve comprises an inner layer of hot melt adhesive and an outer layer formed of the polyolefin.

4. The assembly defined in claim 1, wherein the outer conductor is a corrugated outer conductor.

5. The assembly defined in claim 1, wherein the heat shrink sleeve is a first heat shrink sleeve, and the coaxial cable-connector assembly further comprising a second heat shrink sleeve overlying the first heat shrink sleeve.

6. The assembly defined in claim 1, wherein the assembly satisfies the conditions of IEC-62037.

7. The assembly defined in claim 1, wherein the connector is selected from the group consisting of: 4.3/10 connectors; 7/16 DIN connectors; and N-type connectors.

8. A method of forming a cable-connector assembly, comprising the steps of:

(a) providing a coaxial cable terminated with a coaxial connector, wherein the coaxial cable has an inner conductor, a dielectric layer circumferentially surrounding the inner conductor, an outer conductor circumferentially surrounding the dielectric layer, and a polymeric jacket circumferentially surrounding the outer conductor, and wherein the coaxial connector has a central contact attached to the inner conductor of the coaxial cable, an outer conductor body attached to the outer conductor of the coaxial cable, and at least two dielectric spacers interposed between the central contact and the outer conductor body, wherein one dielectric spacer is positioned separate and apart from the other dielectric spacer;

(b) inserting the terminated cable into a heat shrink sleeve; and (c) heating the heat shrink sleeve to shrink the heat shrink sleeve sufficiently to conformably overlie a portion of the cable jacket and a portion of the outer conductor body of the connector.

9. The method defined in claim 8, wherein the heat shrink sleeve comprises a polyolefin.

10. The method defined in claim 9, wherein the heat shrink sleeve comprises an inner layer of hot melt adhesive and an outer layer formed of the polyolefin.

11. The method defined in claim 8, wherein the outer conductor is a corrugated outer conductor.

12. The method defined in claim 8, wherein the heat shrink sleeve is a first heat shrink sleeve, and the coaxial cable-connector assembly further comprising a second heat shrink sleeve overlying the first heat shrink sleeve.

13. The method defined in claim 8, wherein the assembly satisfies the conditions of IEC-62037.

14. The method defined in claim 8, wherein the connector is selected from the group consisting of: 4.3/10 connectors; 7/16 DIN connectors; and N-type connectors.

15. A coaxial cable-connector assembly, comprising:

(a) a coaxial cable having an inner conductor, a dielectric layer circumferentially surrounding the inner conductor, an outer conductor circumferentially surrounding the dielectric layer, and a polymeric jacket circumferentially surrounding the outer conductor;

(b) a coaxial connector having a central contact attached to the inner conductor of the coaxial cable, an outer conductor body attached to the outer conductor of the coaxial cable, and a dielectric spacer interposed between the central contact and the outer conductor body; and (c) a heat shrink sleeve that conformably overlies a portion of the cable jacket and a portion of the outer conductor body of the connector, wherein the heat shrink sleeve is a first heat shrink sleeve, and the coaxial cable-connector assembly further comprises a second heat shrink sleeve directly overlying the first heat shrink sleeve.

* * * * *